US010029901B2

(12) United States Patent
Clüsserath

(10) Patent No.: US 10,029,901 B2
(45) Date of Patent: Jul. 24, 2018

(54) FILLING ELEMENT, FILLING SYSTEM AND METHOD FOR FILLING CONTAINERS

(71) Applicant: KHS GmbH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 356 days.

(21) Appl. No.: 14/783,590

(22) PCT Filed: Apr. 5, 2014

(86) PCT No.: PCT/EP2014/000922
§ 371 (c)(1),
(2) Date: Oct. 9, 2015

(87) PCT Pub. No.: WO2014/166617
PCT Pub. Date: Oct. 16, 2014

(65) Prior Publication Data

US 2016/0060087 A1 Mar. 3, 2016

(30) Foreign Application Priority Data

Apr. 11, 2013 (DE) ..... 10 2013 103 639

(51) Int. Cl.
*B65B 31/00* (2006.01)
*B67C 3/10* (2006.01)
*B67C 3/26* (2006.01)

(52) U.S. Cl.
CPC ..... *B67C 3/10* (2013.01); *B67C 3/2614* (2013.01); *B67C 2003/2602* (2013.01); *B67C 2003/2657* (2013.01)

(58) Field of Classification Search
CPC . B67C 3/10; B67C 3/2614; B67C 2003/2657; B67C 2003/2602
See application file for complete search history.

(56) References Cited

U.S. PATENT DOCUMENTS

2011/0197996 A1* 8/2011 Clusserath ..... B67C 3/001 141/311 R

FOREIGN PATENT DOCUMENTS

| | | |
|---|---|---|
| DE | 22 60 063 | 6/1974 |
| DE | 75 36 390 | 4/1976 |
| DE | 10 2006 051 237 | 5/2008 |
| DE | 10 2009 009339 | 8/2010 |
| DE | 10 2009 016 322 | 10/2010 |
| DE | 10 2010 022985 | 12/2011 |
| EP | 1 216 952 | 6/2002 |

* cited by examiner

*Primary Examiner* — Jason K Niesz
(74) *Attorney, Agent, or Firm* — Occhiuti & Rohlicek LLP

(57) ABSTRACT

A filling element includes a flushing tube that carries flushing gas used to drive air out of a container's interior before filling it with liquid filling-material. The flushing tube moves between a starting position and a flushing position. In the flushing position, the flushing tube chokes a connection between a gas chamber and a gas channel that leads into a container. In the starting position, this connection is wide open.

11 Claims, 1 Drawing Sheet

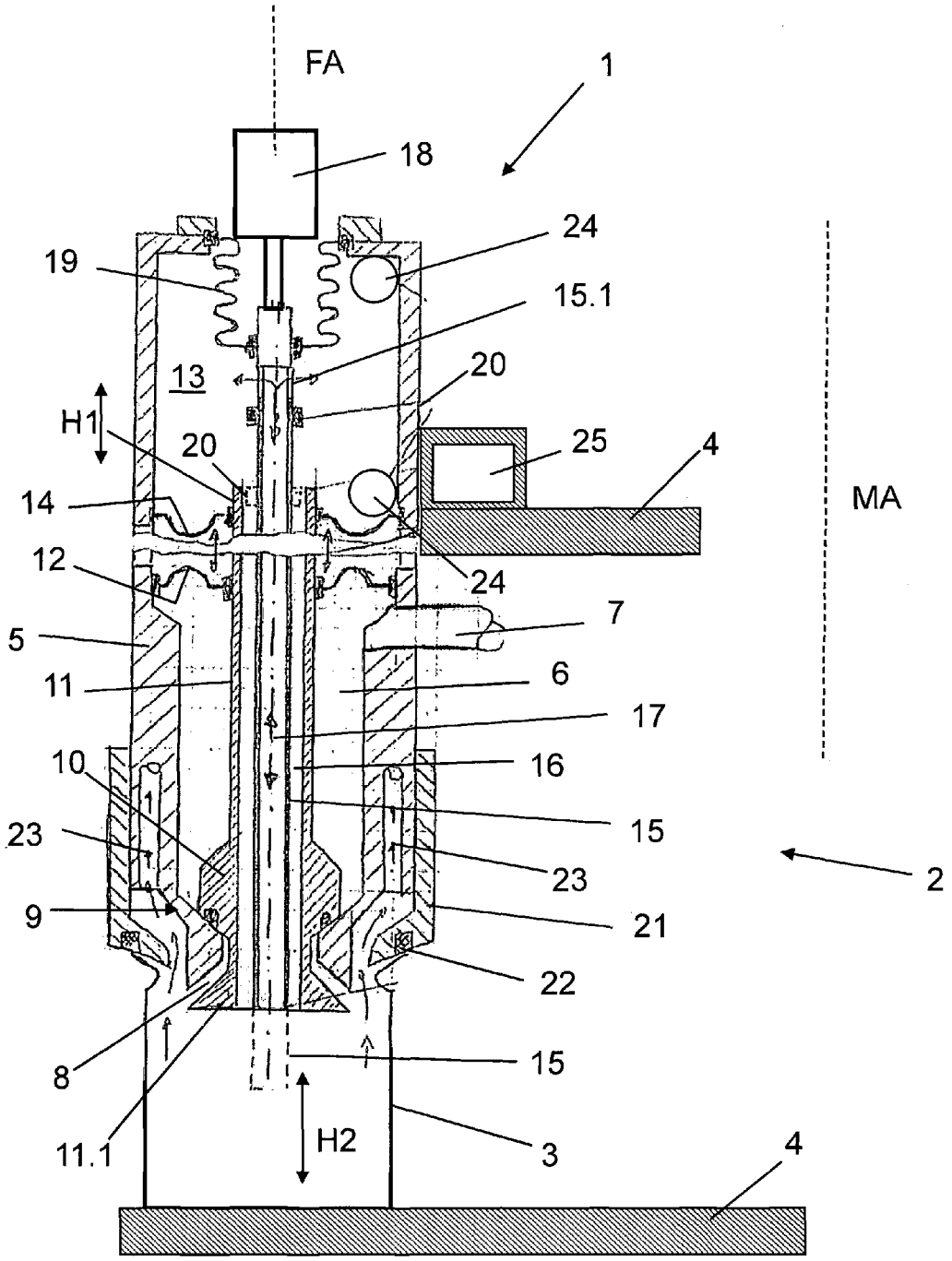
FA
1
18
24
19
15.1
13
20
H1
20
25
4
14
MA
12
24
7
5
6
11
17
10
16
15
23
23
2
9
21
22
8
15
11.1
H2
3
4

FILLING ELEMENT, FILLING SYSTEM AND METHOD FOR FILLING CONTAINERS

RELATED APPLICATIONS

Under 35 USC 371, this application is the national stage of international application PCT/EP2014/000922, filed on Apr. 5, 2014, which claims the benefit of the Apr. 11, 2013 priority date of German application DE 102013103639.2, the contents of which are herein incorporated by reference.

FIELD OF INVENTION

The invention relates to container processing, and in particular, to filling containers.

BACKGROUND

Filling elements and filling systems for filling containers with a liquid filling-material are known. Since oxygen in the air can harm product quality, many of these filling systems expel air from the container before filling it. One way to do this is to seal a container tightly against the filling element before filling it, and flushing the container's interior with a flushing gas. A suitable flushing gas is an inert gas, for example, CO2 gas or nitrogen.

Flushing usually takes place by introducing a gas or flushing tube that can be lowered into the container's interior. This flushing tube introduces flushing gas into the container's interior. To optimize flushing, it is best to insert the flushing tube as far into the container as possible.

A return-gas tube surrounds the flushing tube to form a return-gas channel between the flushing tube and the return-gas tube. This return-gas channel opens into a gas chamber in the filling element and is part of a controlled gas path.

SUMMARY

An object of the invention is that of providing a filling element that optimizes flushing of containers with flushing gas, and at the same time optimizes tempering and filling of containers.

In a filling element according to the invention, a flushing tube surrounded by a first gas-channel of a return-gas tube is lowered from a raised starting-position into a lowered flushing-position. The flushing tube and a first gas-channel opens into a gas chamber formed in the filling element. Purely by lowering the flushing tube into the flushing position, the connection between the first gas-channel and this gas chamber is closed or severely choked so that a flushing gas supplied to the gas chamber is blown exclusively or substantially exclusively via the lowered flushing tube centrally into the container interior of a container arranged tightly against the filling element. It is sufficient here if the pressure of the flushing gas, which e.g. is CO2 gas and/or nitrogen and/or water vapor, lies only slightly above atmospheric or ambient pressure. As a result, optimum flushing is achieved with reduced flushing gas consumption and reduced operating costs.

During tempering and filling of the container, which is still arranged tightly against the filling element, the flushing tube is moved back into its upper or raised starting-position so that it no longer extends into the part of the container interior to be filled with the filling-material. The return movement of the flushing tube into the raised starting-position completely re-opens the connection between the first gas-channel and the gas chamber so that the tempering gas used for tempering, e.g. CO2 gas and/or nitrogen, is conducted into the container interior via this gas chamber and via the first gas-channel and second gas-channel, i.e. via a large total flow cross-section, and in a subsequent filling phase, also via the first gas-channel and second gas-channel, i.e. via a large total flow cross-section. The tempering gas displaced by the filling-material can be discharged as a return gas to the gas chamber and from there to a collection chamber. Since closure or choking of the connection between the first gas-channel and the gas chamber, and the reopening of this connection, take place purely by the movement of the flushing tube, no additional control valves or control signals are necessary for controlling this connection.

In one aspect, the invention features an apparatus for flushing air out of a container prior to filling the container with liquid filling-material. Such an apparatus includes a filling system that has a filling element. The filling element has a housing that forms a liquid-carrying channel therein and that has a discharge opening at an underside thereof through which liquid filling-material enters a container. A liquid-dispensing valve is disposed along this liquid-carrying channel for controlling flow of liquid into the container. A return-gas tube surrounded by a flushing tube also forms an opening at the underside of the filling element. The space between the return-gas tube and the flushing tube defines a first gas-channel that opens at its lower end into the container and that opens at its upper end into a gas chamber formed in the housing. The flushing tube's interior defines a second gas-channel that opens into the container at the flushing tube's lower end and opens into the gas chamber at the flushing tube's upper end. The flushing tube is movable along the filling element axis through a first stroke between a raised starting-position and a lowered flushing-position. Meanwhile, a controlled gas path admits flushing gas under flushing pressure into the gas chamber. Movement of the flushing tube causes a flow cross section of a connection between the gas chamber and the first gas-channel to transition between a first value and a second value that is greater than the first value. In particular, when the flushing tube is in the flushing position, the flow cross section is equal to the first value. Then, when the flushing tube is in the starting position, the flow cross section is equal to the second value.

In some embodiments, the flushing tube comprises a choke body that, when the flushing tube is in the flushing position, at least partially closes the connection. Among these are embodiments in which the flushing tube comprises a thickened portion. In these embodiments, when the flushing tube is in the lowered position, the return-gas tube accommodates the thickened portion thereby at least partially closing the connection.

In other embodiments, the liquid-dispensing valve further comprises a valve body and a valve piston. The return-gas tube forms the valve piston for the valve body. This valve piston is movable with the return-gas tube axially along the filling element axis through a second stroke that is shorter than the first stroke.

In yet other embodiments, the gas chamber is configured to switch between being connected to a source of pressurized tempering gas for tempering containers and being connected to a collection chamber for receiving return gas that has been displaced from the container via the first and second gas-channels during filling of the container with the liquid filling-material.

Also among the embodiments are those that include a transport element. In these embodiments, the filling element is one of a plurality of identical filling elements disposed on the transport element.

In another aspect, the invention features a method comprising causing a container to be sealed tightly against a filling element, causing a flushing tube that defines a second gas-channel and that is surrounded by a return-gas tube that forms a first gas-channel between the flushing tube and the return-gas tube to be lowered from a raised starting-position into a lowered flushing-position in which the flushing tube extends into the container, thereby causing the first gas-channel and the second gas-channel to be opened into an interior of the container, and reducing a flow cross section of a connection between the first gas-channel and a gas chamber.

Among the practices of the invention are those that include introducing tempering gas from the gas chamber into the container. This includes introducing the tempering gas by raising the flushing tube to the starting position, thereby increasing the flow cross section, and introducing tempering gas through both the first and second channels.

Also among the practices are those that include receiving gas displaced from the container during filling of the container with liquid filling-material, wherein receiving comprises raising the flushing tube to the starting position, thereby increasing the flow cross section, and receiving the gas into the gas chamber.

As used herein, the phrase "container arranged tightly against the filling element" refers to a container that lies with its container mouth pressed tightly against the filling element or against a seal there.

As used herein, "pressure filling" generally means a filling process in which the container to be filled lies tightly against a filling element and, usually before the actual filling phase i.e. before opening of the liquid valve, the container is tempered with a pressurized tempering gas or inert gas, such as CO2 gas and/or nitrogen, via at least one controlled gas path formed in the filling element, with this gas being increasingly displaced from the container interior as a return gas flowing through a controlled gas path formed in the filling element as liquid filling-material flows into the container.

As used herein, "substantially" or "approximately" mean deviations from a precise value by ±10%, preferably by ±5%, and/or deviations that are insignificant to function.

BRIEF DESCRIPTION OF THE FIGURE

These and other features of the invention will be apparent from the following detailed description and the accompanying FIGURE, which shows a filling element of a filling system for filling containers.

DETAILED DESCRIPTION

The FIGURE shows a filling element 1 that is suitable for pressure filling a container 3 with a liquid filling-material. In the particular embodiment shown, the container 3 is a can. The filling element 1 is one of a plurality of identical filling elements 1 on a rotor 4 that rotates about a vertical machine axis MA.

The filling element 1 includes a filling-element housing 5 having a liquid-carrying channel 6 formed therein. A product line 7 connects the liquid-carrying channel 6 to a filling-material vessel provided on the rotor 4. This filling-material vessel is connected to all of the filling elements 1 of the filling system 2.

On the underside of the filling element 1, the liquid-carrying channel 6 forms an annular discharge opening 8 that surrounds a vertical filling element axis FA. During filling, liquid filling-material flows through this opening 8 into a container 3 that is sealed tightly against the filling element 1.

On the liquid-carrying channel 6 between the product line 7 and the discharge opening 8 is a liquid-dispensing valve 9 having a valve body 10. The valve body 10 surrounds a return-gas tube 11 that is coaxial with the filling element axis FA and that serves as a valve piston. A top end of the return-gas tube 11 passes through a first membrane seal 12 in an upper region of the liquid-carrying channel 6.

At its lower end, below the liquid-dispensing valve 9 and in the region of the discharge opening 8, the return-gas tube 11 forms a skirt 11.1. During filling, this skirt 11.1 conducts liquid filling-material radially outward relative to the filling element axis FA.

The FIGURE shows the liquid-dispensing valve 9 in its closed position. An actuator raises and lowers the return-gas tube 11, and with it, the valve body 10. This opens and closes the liquid-dispensing valve 9. The extent of this axial movement defines a first stroke H1.

The return-gas tube 11 has a lower end and an upper end. The lower end of the return-gas tube 11 opens at the underside of the filling element 8. The upper end of the return-gas tube 11 opens into a gas chamber 13 formed in the filling-element housing 5. On its way into the gas chamber 13, the return-gas tube 11 passes through a second membrane seal 14 that seals off the gas chamber 13. Between the first and second membrane seals 12, 14 is a pneumatic actuator.

The return-gas tube 11 surrounds a flushing tube 15 that is coaxial with the filling element axis FA. The return-gas tube 11 and the flushing tube 15 together define an annular first gas-channel 16 between them.

The flushing tube 15 has a top end and a bottom end. The bottom end of the flushing tube 15 opens at the underside of the filling element 1. The top end of the flushing tube 15 has side openings 15.1 that lead into the gas chamber 13. A second gas-channel 17 extends between the bottom end of the flushing tube 15 and the top end of the flushing tube 15.

An actuator 18 moves the flushing tube 15 through a second stroke H2 along the filling element axis FA. A suitable actuator 18 is a double-action pneumatic cylinder.

The second stroke H2 is longer than the first stroke H1. As a result, when the flushing tube 15 is in an upper starting position, as shown in the FIGURE, its lower end does not protrude beyond the skirt 11.1 and is in fact arranged at the same level or substantially the same level as the lower end of the return-gas tube 11. On the other hand, when the flushing tube 15 is in its flushing position, it protrudes beyond the underside of the return-gas tube 11 and into the container interior by at least the length of the second stroke H2.

The upper end of the flushing tube 15 connects to a piston rod of the actuator 18, which is arranged outside the filling-element housing 5. In the region of this actuator 18, a bellows seal 19 seals off the gas chamber 13.

Below its upper side openings 15.1, the flushing tube 15 has a thickened portion 20. In some embodiments, a ring placed on the flushing tube 15 forms the thickened portion 20. A suitable ring for this purpose is a sealing ring.

When the flushing tube 15 is in its flushing position, the thickened portion 20 closes, or at least severely chokes, a connection between the first gas-channel 16 and the gas chamber 13, thus greatly constricts its effective flow cross-section, in particular also when the liquid-dispensing valve 9 is closed.

In the embodiment shown, when the flushing tube 15 is in the flushing position, the return-gas tube 11 accommodates the thickened portion 20. More specifically, an upper region of the return-gas tube 11 accommodates the thickened portion 20.

A sleeve 21 surrounds the filling-element housing 5 tightly on a lower housing portion thereof. The sleeve 21 can be raised and lowered in the direction of the filling element axis FA. An external control curve, which does not rotate with the rotor, controls the movement of the sleeve 21. A lower end of the sleeve 21 has an annular seal 22 that surrounds the filling element axis FA and that presses tightly against an opening or mouth edge of the container 3.

The filling-element housing 5 forms various controlled gas paths. Among these are third and fourth gas-channels 23 that are on opposite sides of the sleeve 21, 180° apart as measured on a circle centered on the filling element axis FA, and a fifth gas-channel 24 that opens into either an upper region or a lower region of the gas chamber 13.

The third and fourth gas-channels 23 function as return-gas channels. When a container 3 is arranged tightly against the filling element 1, the third and fourth gas-channels 23 open via the interior of the sleeve 21 into the container interior at points that are offset radially outward relative to both the discharge opening 8 and to the filling element axis FA.

The filling system 2 carries out a number of different filling procedures. Among these is pressure filling. Pressure filling begins with flushing an empty container's interior with a flushing or inert gas, such as carbon dioxide, nitrogen and/or water vapor. This removes ambient air containing oxygen that may harm the product.

With a container 3 standing vertically on its base, and with the conainer's axis aligned with the filling element axis FA, pressure filling begins with lowering the sleeve 21 onto an opening edge of a container 3. The container 3 then lies with its opening edge tightly against the seal 22 and is therefore in a sealed position on the filling element 1.

The next step is that of flushing any enclosed air out of the container's interior. This is carried out by closing the liquid-dispensing valve 9 and causing the actuator 18 to lower the flushing tube 15 from its starting position, through the second stroke H2, and into its flushing position. The length of the second stroke H2 is selected such that, when the flushing tube 15 is in its flushing position, its lower end is closer to the container's base than it is to the container's opening. Lowering the flushing tube 15 this way closes or severely chokes a connection between the first gas-channel 16 and the gas chamber 13.

Next comes the step of blowing flushing gas into the container. Flushing gas enters the gas chamber 13 from the fifth gas-channel 24. From there, it proceeds down the flushing tube's second gas-channel 17 and on into the container's interior.

Flushing gas then exits the flushing tube 15 near the container's base. It flows along the container's base, up the container's peripheral wall, and eventually out of the container's interior via the third and fourth gas-channels 23. In doing so, the flushing gas displaces ambient air out of the container's interior and expels it through the third and fourth gas-channels 23. Since the flushing gas tube 15 extends deeply into the container and aligns with the filling element axis FA, it is possible to achieve optimum flushing even with a flushing gas pressure that is only slightly above ambient pressure.

In some embodiments, the third and fourth gas-channels 23 guide the expelled gases into the environment. In other embodiments, they guide the expelled gases into a ring channel 25 that is provided on the rotor 4 and that is common to all filling elements 1 of the filling system 2. In those embodiments that use the ring channel 25, the pressure within the ring channel 25 can be either ambient pressure or lower than ambient pressure. In either case, the flushing pressure lies only slightly above atmospheric pressure.

After flushing, the flushing tube 15 moves back into the starting position to prepare for the filling phase. When the flushing tube 15 is in the starting position, the thickened portion 20 moves out of the return-gas tube 11 and hence completely opens the connection between the first gas-channel 16 and the gas chamber 13.

The next step, before the liquid-dispensing valve 9 actually opens, is to temper the container with pressurized tempering gas. This process begins with closing the third and fourth channels 23. Then, the fifth gas-channel 24 admits a suitable pressurized tempering gas into the gas chamber 13. A suitable tempering gas is carbon dioxide and/or nitrogen. This tempering gas flows through the first and second gas-channels 16, 17. Since both the first and second gas-channels 16, 17 are used, the total flow cross-section available for carrying tempering gas becomes greater. For a given flow velocity, this reduces the time required for tempering.

After tempering, the container 3 is finally ready to receive the liquid filling-material. This takes place by opening the liquid-dispensing valve 9 or lifting the return-gas tube 11 through the first stroke H1. Since the second stroke H2 is larger than the first stroke H1, the connection of the first and second gas-channels 16, 17 with the gas chamber 13 remains wide open. As liquid filling-material flows into the container 3, it displaces the tempering gas, via both the first and second gas-channels 16, 17, into the gas chamber 13 and eventually out of the filling element via the fifth gas-channel 24.

When sufficient liquid filling-material has entered the container, the liquid-dispensing valve 9 closes. Excess pressure in the filled container 3 is then relieved from the container via the third and fourth channels 23. The pressure filling procedure then ends with raising the sleeve 21, so that the filled container 3 can be removed from the filling element 1.

The foregoing system can also be used for CIP cleaning and disinfecting the filling element 1. In this application, a CIP flushing closure is arranged tightly against the filling element 1 and the product line 7 and the fifth gas-channel 24 carry CIP cleaning and/or disinfectant media in or out of the filling element 1.

The invention has been described above with reference to an exemplary embodiment. Evidently numerous changes and derivations are possible without leaving the inventive concept on which the invention is based.

Having described the invention, and a preferred embodiment thereof, what is claimed as new, and secured by Letters Patent is:

1. An apparatus for flushing air out of a container prior to filling said container with liquid filling-material, said apparatus comprising a filling system that comprises a filling element, said filling element comprising a controlled gas path, a discharge opening, a first gas channel, a flushing tube, a gas chamber, a housing, a liquid-carrying channel, a liquid-dispensing valve, a return gas tube, and a second gas channel, wherein said liquid-carrying channel is formed in said housing, wherein said discharge opening is disposed at an underside of said filling element, wherein liquid filling-material enters said container through said discharge opening, wherein said liquid-dispensing valve is disposed along said liquid-carrying channel, wherein said return gas tube comprises an opening on said underside of said filling element, wherein said return gas tube surrounds said flushing tube, wherein said first gas channel is defined between an inner face of said return gas tube and an outer face of said flushing tube, wherein said first gas channel is open at lower end of said return gas tube, wherein said second gas channel is formed in an interior of said flushing tube, wherein said second gas channel is open at a lower end of said flushing tube, wherein said gas chamber is formed in said housing, wherein said first gas channel opens into said gas chamber, wherein said flushing tube is movable along said filling element axis through a first stroke between a raised starting position and a lowered flushing position, wherein said controlled gas path admits flushing gas under flushing pressure into said gas chamber, wherein said second gas channel opens into said gas chamber, wherein movement of said flushing tube causes a flow cross section of a connection between said gas chamber and said first gas channel to transition between a first value and a second value, wherein, when said flushing tube is in said lowered flushing position, said flow cross section is equal to said first value, wherein, when said flushing tube is in said raised starting position, said flow cross section is equal to said second value, wherein said first value is less than said second value, wherein said flushing tube comprises a choke body that, when said flushing tube is in said lowered flushing position, at least partially closes said connection, and wherein said flushing tube comprises a thickened portion, wherein, when said flushing tube is in said lowered position, said return gas tube accommodates said thickened portion thereby at least partially closing said connection.

2. The apparatus of claim 1, wherein said thickened portion partially closes said connection.

3. The apparatus of claim 1, wherein said thickened portion closes said connection.

4. The apparatus of claim 1, wherein said liquid-dispensing valve further comprising a valve body and a valve piston, wherein said return gas tube forms said valve piston for said valve body, wherein said valve piston is movable with said return gas tube axially along said filling element axis through a second stroke that is shorter than said first stroke.

5. The apparatus of claim 1, wherein said gas chamber is configured to switch between being connected to a source or pressurized tempering gas for tempering containers and being connected to a collection chamber for receiving return gas that has been displaced from said container via said first and second gas channels during filling of said container with said liquid filling-material.

6. The apparatus of claim 1, further comprising a transport element, wherein said filling element is one of a plurality of identical filling elements disposed on said transport element.

7. A method comprising causing a container to be sealed tightly against a filling element, causing a flushing tube that defines a second gas channel and that is surrounded by a return gas tube that forms a first gas channel between said flushing tube and said return gas tube to be lowered from a raised starting position into a lowered flushing position in which said flushing tube extends into said container, thereby causing said first gas channel and said second gas channel to be opened into an interior of said container, and reducing a flow cross section of a connection between said first gas channel and a gas chamber, wherein said flushing tube comprises a choke body that, when said flushing tube is in said lowered flushing position, reduces said flow cross section of said connection by at least partially closing said connection, and wherein said flushing tube comprises a thickened portion, wherein, when said flushing tube is in said lowered position, said return gas tube accommodates said thickened portion thereby at least partially closing said connection.

8. The method of claim 7, further comprising introducing tempering gas from said gas chamber into said container, wherein introducing said tempering gas comprises raising said flushing tube to said starting position, thereby increasing said flow cross section, introducing tempering gas through said first channel, and introducing tempering gas through said second channel.

9. The method of claim 7, further comprising receiving gas displaced from said container during filling of said container with liquid filling-material, wherein receiving comprises raising said flushing tube to said starting position, thereby increasing said flow cross section, and receiving said gas into said gas chamber.

10. The method of claim 7, wherein reducing a flow cross section of said connection comprises using said thickened portion to close said connection.

11. The method of claim 7, wherein reducing a flow cross section of said connection comprises using said thickened portion to partially close said connection.

* * * * *